US005534122A

United States Patent [19]

Traini et al.

[11] Patent Number: 5,534,122

[45] Date of Patent: Jul. 9, 1996

[54] CELL HAVING A POROUS DIAPHRAGM FOR CHLOR-ALKALI ELECTROLYSIS AND PROCESS USING THE SAME

[75] Inventors: Carlo Traini; Giovanni Meneghini, both of Milan, Italy

[73] Assignee: De Nora Permelec S.p.A., Milan, Italy

[21] Appl. No.: 412,754

[22] Filed: Mar. 29, 1995

Related U.S. Application Data

[63] Continuation of Ser. No. 189,098, Jan. 31, 1994, abandoned.

[30] Foreign Application Priority Data

Feb. 12, 1993 [IT] Italy ..... MI93A0257

[51] Int. Cl.[6] ..... C25B 9/00

[52] U.S. Cl. ..... 204/266; 204/263; 204/275; 204/278

[58] Field of Search ..... 204/95, 128, 284, 204/286, 288, 257, 258, 263, 265

[56] References Cited

U.S. PATENT DOCUMENTS

| | | | |
|---|---|---|---|
| 3,674,676 | 7/1972 | Fogelman | 204/286 |
| 4,444,632 | 4/1984 | de Nora | 204/98 |
| 4,448,664 | 5/1984 | Ikegami et al. | 204/286 |
| 5,066,378 | 11/1991 | Meneghini | 204/237 |
| 5,221,452 | 6/1993 | Nakao et al. | 204/258 |

OTHER PUBLICATIONS

Modern Chlor–Alkali Technology; Society of Chemical Industry, London, 1980.

*Primary Examiner*—Kathryn Gorgos

*Attorney, Agent, or Firm*—Charles A. Muserlian; Bierman and Muserlian

[57] ABSTRACT

A chlor-alkali diaphragm electrolysis cell comprising pairs of interleaved cathodes (C) and anodes (B), said cathodes having surfaces with openings and are provided with porous corrosion resistant diaphragms, said cell further comprising feed brine inlets and outlets (H, I, L) for the removal of produced chlorine, hydrogen and caustic, said anodes (B) are expanded by internal extenders (F) and have electrode surfaces with openings for releasing produced gaseous chlorine, characterized in that each of said expanded anodes (B) comprises a plurality of pressing means (O,Q) made of corrosion resistant material having elastic properties to maintain the electrode surfaces of the anodes against the diaphragm and said pressing means are longitudinally positioned inside the anodes having very low operating voltages.

11 Claims, 4 Drawing Sheets

CELL HAVING A POROUS DIAPHRAGM FOR CHLOR-ALKALI ELECTROLYSIS AND PROCESS USING THE SAME

PRIOR APPLICATION

This application is a continuation of U.S. patent application Ser. No. 189,098 filed Jan. 31, 1994, now abandoned.

STATE OF THE ART

Chlor-alkali electrolysis is certainly the electrolytic process of greatest industrial interest. In general terms, said electrolysis process may be illustrated as the splitting of a starting reactant, which is an aqueous solution of sodium chloride (hereinafter defined as brine), to form gaseous chlorine, sodium hydroxide in an aqueous solution and hydrogen. This splitting is made possible by the application of electrical energy which may be seen as a further reactant. Chlor-alkali electrolysis is carried out resorting to three technologies: with mercury cathodes cells, with porous diaphragms cells or with ion exchange membranes cells. This latter represents the most modern development and is characterized by low energy consumptions and by the absence of environmental or health drawbacks. Of the others, the mercury cathodes cells are probably destined for a sharp decline in use because of the severe restrictions adopted by most countries as regards the release of mercury to the atmosphere and soil. In fact, the most modern cell designs allow one to meet the severe requirements of the present regulations, but the public opinion rejects "a priori" any process which could lead to the possible release of heavy metals in the environment.

The diaphragm process also has problems as the main component of the diaphragm is asbestos fibers, which is recognized to be a mutagenic agent. The most advanced technology foresees a diaphragm made by depositing a layer of asbestos fibers mixed with certain polymeric binders onto cathodes made of iron meshes. The structure thus obtained is then heated whereby the fusion of the polymeric particles permits the mechanical stabilization of the agglomerate of asbestos fibers. As a consequence, the release of fibers during operation (particularly in the drain liquids of the plant) is minimized, as well as the release to the atmosphere due to various expedients adopted during manipulation of the asbestos in the deposition step.

However, this appears to be only sufficient to prolong the life of the diaphragm technology, in view of the ever increasing difficulty in the supply of asbestos fibers due to the progressive closing of the mines. For this reason, porous diaphragms have been developed where the asbestos fibers are substituted by fibers of inorganic materials considered to be completely safe, such as zirconium oxide, mechanically stabilized by polymeric binders. The deposition and the stabilization by heating in oven are carried out following the same procedure adopted for asbestos diaphragms.

In the last few years, graphite anodes have been nearly completely substituted by dimensionally stable anodes made of a titanium substrate coated by an electrocatalytic film based on noble metal oxides. In the plants using the most advanced technologies, the dimensionally stable anodes are of the expandable type, which permits one to minimize the gap between the anode and the cathode, with the consequent reduction of the cell voltage. The anode-cathode gap is intended here to be the distance between the surface of the anodes and that of the diaphragm deposited onto the cathodes. Expandable anodes as described for example in U.S. Pat. No. 3,674,676 have the shape of a box with a rectangular cross-section, rather flat, the electrode surfaces of which are kept in a contracted position by means of suitable retainers while the anode is inserted between the cathodes during assembling of the cell. Before start-up, the anode electrode surfaces are released and are moved towards the surfaces of the diaphragms by suitable spreading means or extenders. Spacers may be introduced between said electrode surfaces and the diaphragms. These technological improvements brought the cost of production of chlorine and caustic obtained by the diaphragm technology quite close, even if somewhat higher, to those obtained by the membrane technology.

It is, therefore, the current opinion of industry that diaphragm cells plants may still remain in operation for a long time and the future of these plants could be even more promising if the following inconveniences still penalizing the technology are overcome:

- cell voltages higher than that theoretically obtained by the expansion of the anodes. It is well known that the cell voltage linearly decreases with the decrease of the anode-cathode gap. Said result is connected to the lower ohmic drop in the brine layer between the diaphragm and the anode. However, for anode-cathode distances below a certain limit, usually 3.5–4 mm, the cell voltage remain more or less constant or even increases (see Winings et al. in Modern Chlor-Alkali Technology, 1980, pages 30–32). This negative behaviour, quite unsatisfactory, is commonly attributed to the chlorine bubbles which are entrapped in the thin brine layer between the anode and the diaphragm. The problem is partially solved by resorting to the use of internal hydrodynamic means as described in U.S. Pat. No. 5,066,378. Said means are directed to promote a strong circulation of brine capable of removing the chlorine bubbles;
- increase of the cell voltage in the electrolysis which increase is commonly ascribed to gas entrapping inside the pores, favoured by insufficient hydrophilic properties of the material forming the diaphragm, in particular in the case of diaphragms containing polymeric binders, as suggested by Hine in Electrochemical Acta Vol. 22, page 429 (1979). The increase of cell voltage may also be due to precipitation of impurities contained in the brine inside the diaphragms;
- deposition of metallic iron or electrically conductive compounds of iron, such as magnetite, formed by reduction at the cathode, with growth of dendrites in the diaphragm and evolution of hydrogen in the anode compartment (hydrogen in the chlorine which is explosive). This problem is most likely to occur with diaphragms characterized by a scarcely tortuous porosity, as discussed by Florkiewicz et al. at the 35th Seminar of the Chlorine Institute, New Orleans, La., USA, Mar. 18, 1992;
- decrease of the faradic efficiency in the electrolysis run;
- reduced life of the diaphragm.

OBJECTS OF THE INVENTION

It is an object of the invention to provide an improved diaphragm chlor-alkali electrolysis cell which permits the substantial elimination of the inconveniences of the prior art and to provide an improved electrolysis process using the improved diaphragm electrolysis cell of the invention.

It is another object of the invention to provide an improved anode structure of the expandable type for diaphragm electrolysis cells.

These and other objects and advantages of the invention will become obvious from the following description.

SUMMARY OF THE INVENTION

The present invention relates to a chlor-alkali diaphragm electrolysis cell which permits the reduction in voltage with respect to the typical values obtained with the prior art diaphragm cells. The cell of the invention comprises expandable anodes, the electrode surfaces of which, after expansion by suitable spreading means or extenders, are further pressed against the diaphragm deposited onto the cathodes by pressing means or springs capable of exerting sufficient pressure while maintaining the typical elasticity of the anode. This elasticity is essential in order to obtain a homogeneous pressure exerted against the diaphragm even after start-up of the cell when the temperature increases to 90°–95° C. and the various components undergo different expansions depending on the construction materials. This elasticity is further necessary to avoid that excessive pressure be exerted against the diaphragm, causing damages as would certainly occur with rigid pressure means.

Preferred embodiments of the present invention will be now described making reference to the drawings.

DESCRIPTION OF THE INVENTION

Figure 1:
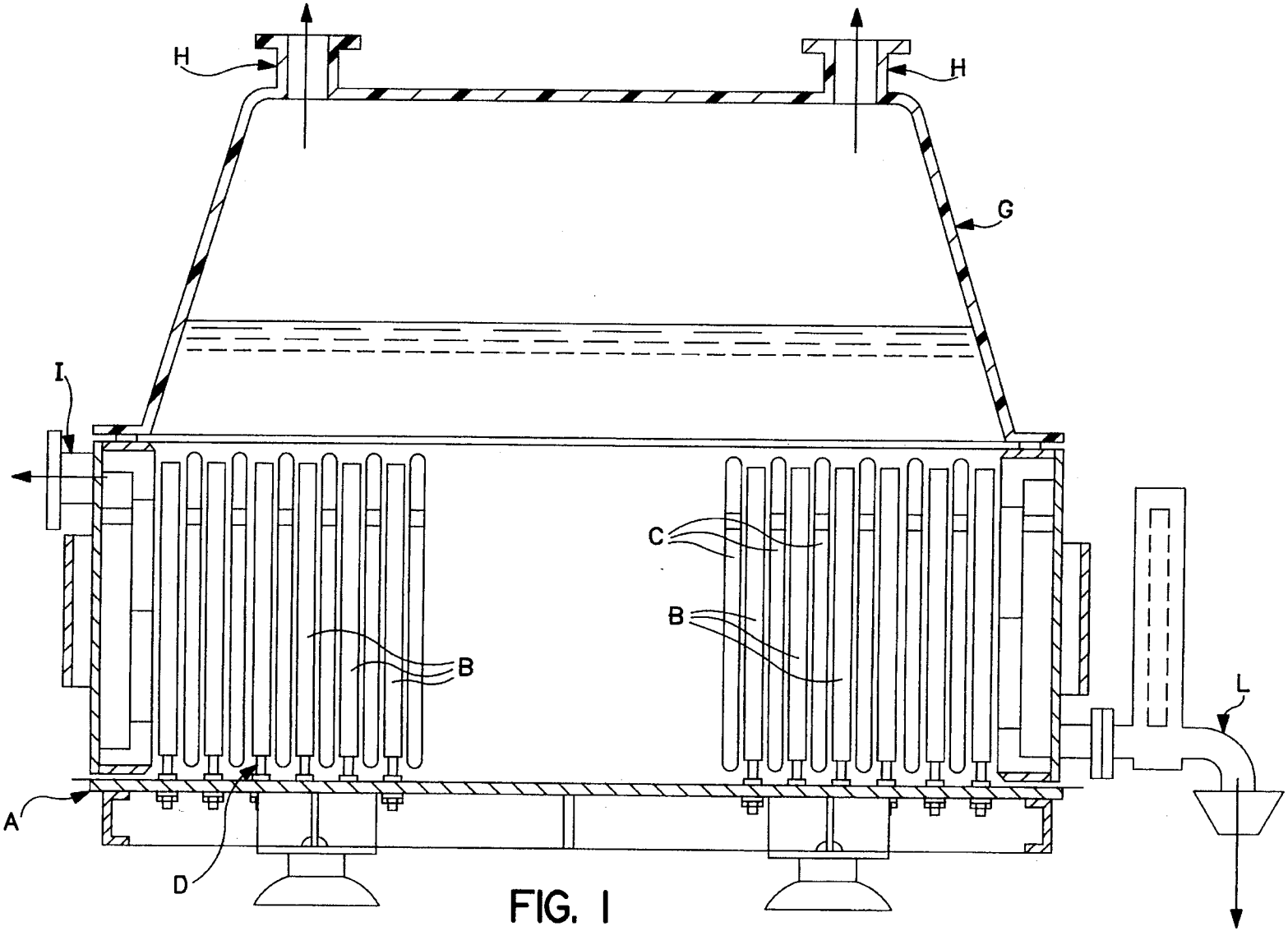
FIG. 1 is a cross sectional longitudinal view of a conventional diaphragm cell for chlor-alkali electrolysis comprising the anodes of the present invention.

In FIG. 1, the diaphragm electrolysis cell comprises a base (A) on which expandable anodes (B) are secured by means of conductor bars (D). The cathodes (C) are made of a mesh or punched sheet of iron and are provided with diaphragms. Spacers (not shown in the figure) may be optionally inserted between the surfaces of said anodes and the diaphragms. The cover (G) is made of corrosion resistant material with outlets (H) for chlorine and brine inlets (not shown). Hydrogen and caustics are released through (I) and (L), respectively.

Figure 2:
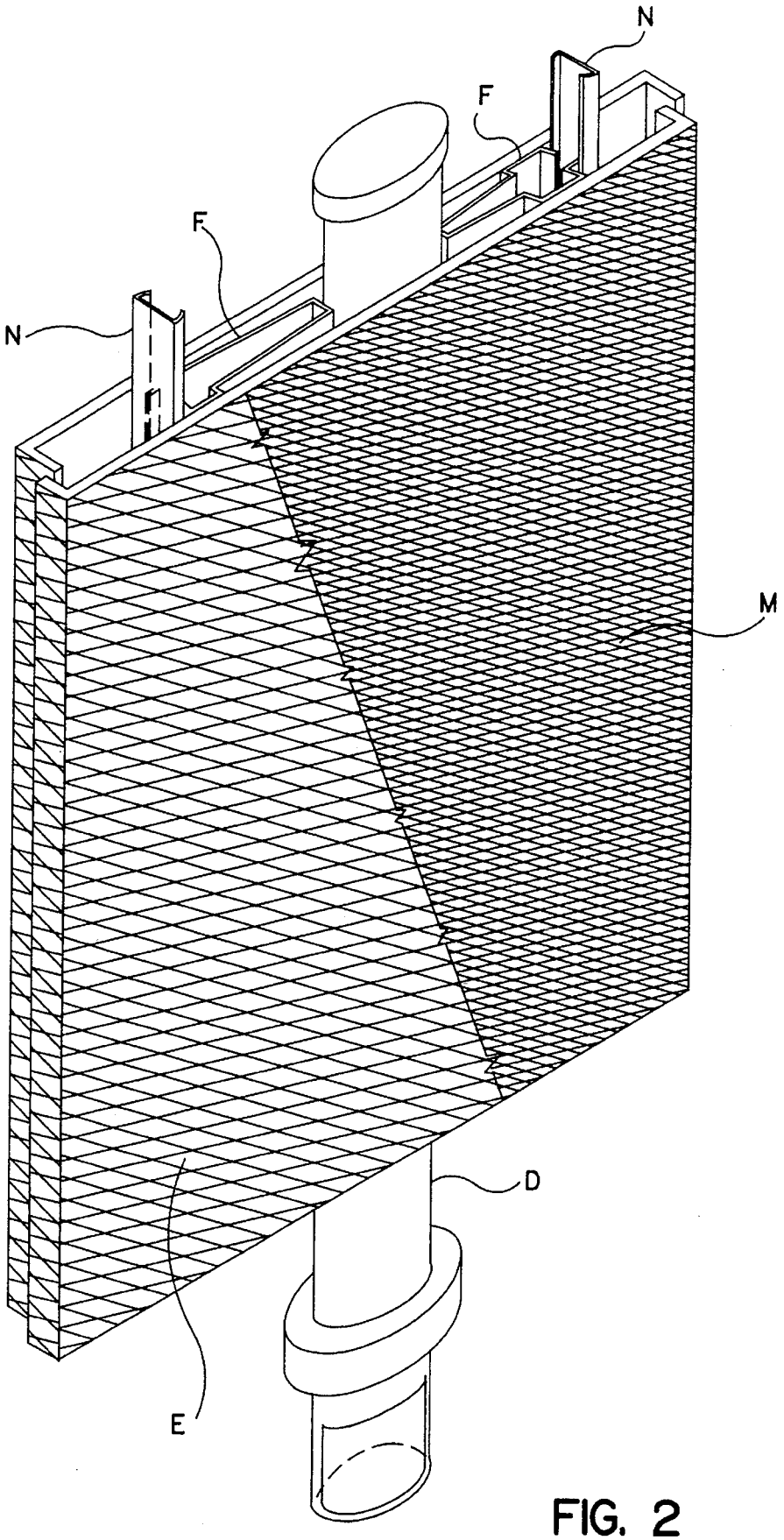
FIGS. 2 and 3 illustrate the anodes before and after insertion of the pressing means of the present invention.

FIG. 2 illustrates in detail the expandable anodes (B) in the contracted position, comprising electrodes surfaces made of a coarse mesh (E) and a fine mesh (M) fixed thereto, internal spreading means or extenders (F) and retainers (N).

Figure 3:
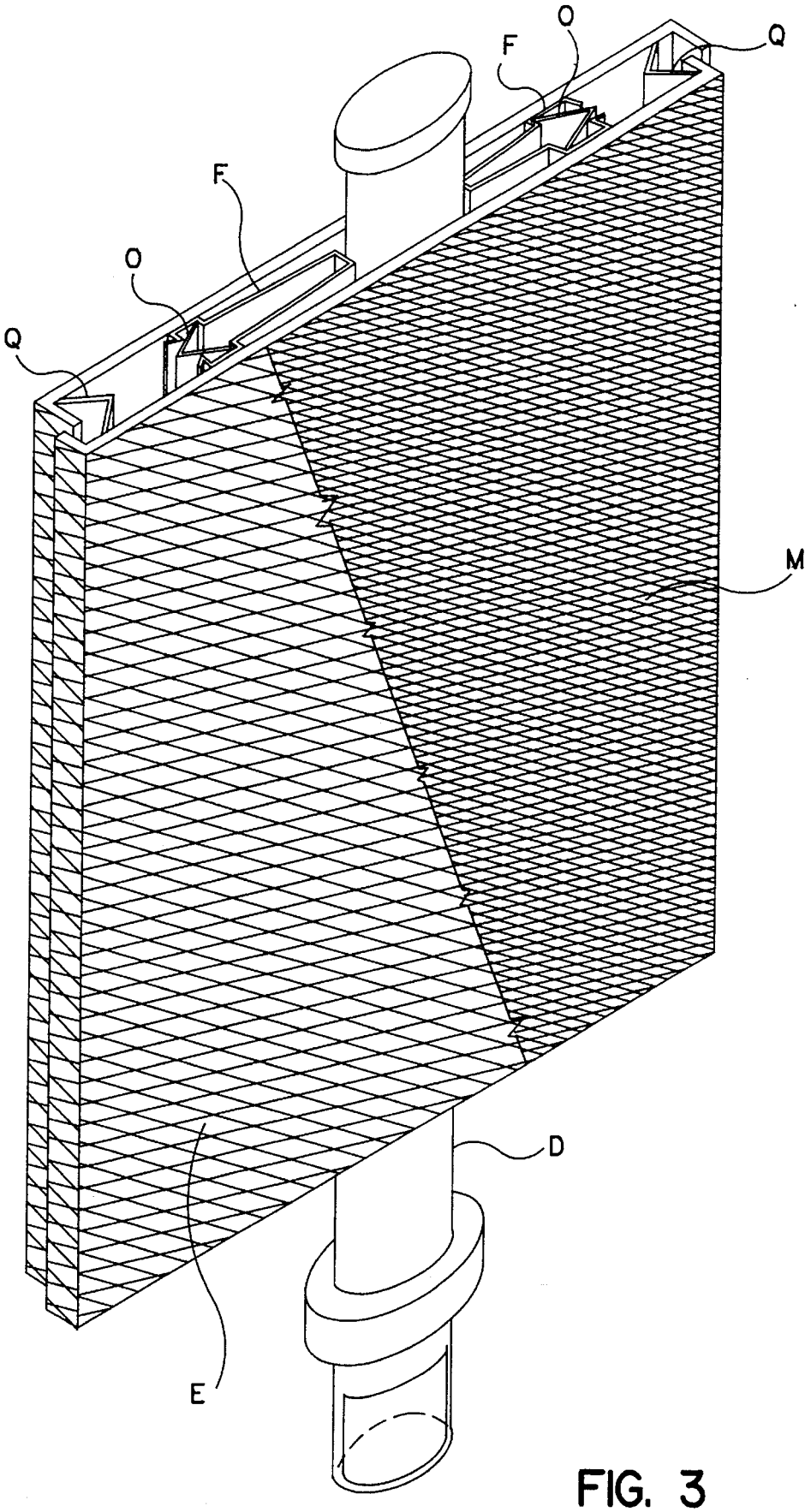

FIG. 3 describes the same anode of FIG. 2 in the expanded position after removal of the retainers and after insertion of the pressing means of the invention (O, Q). In this arrangement, four pressing means are shown. In particular, pressing means (O), differently from pressing means (Q) form with the internal surfaces of the extenders (F) downcomers to convey the doncoming flow of the degassed brine.

Figure 4:
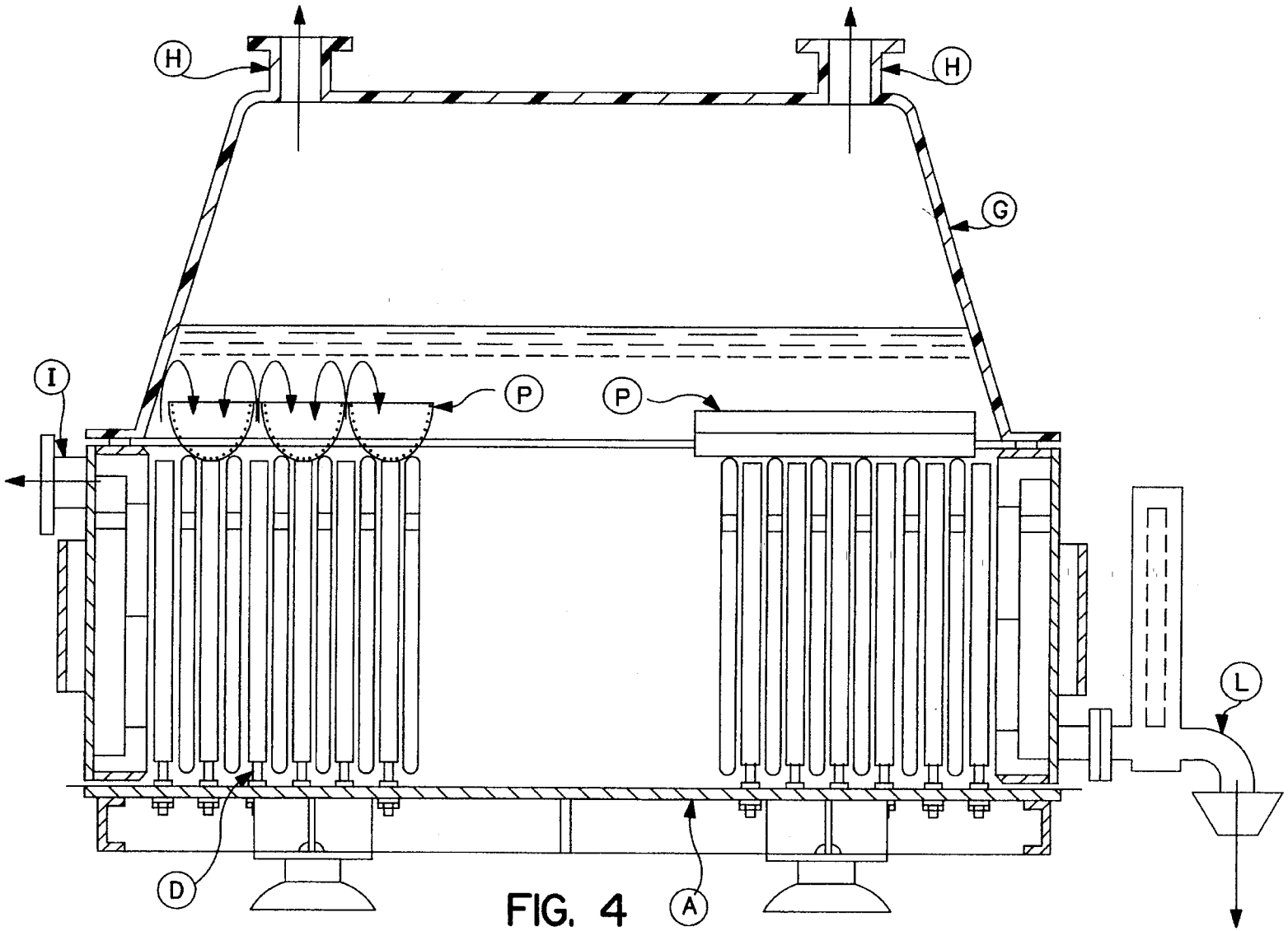
FIG. 4 is a cross sectional longitudinal view of the cell of FIG. 1 further comprising prior hydrodynamic means as illustrated in Example 4.

In FIG. 4 the electrolysis cell of FIG. 1 is further provided with hydrodynamic means (P), same as described in U.S. Pat. No. 5,066,378. Said hydrodynamic means are represented in two alternative positions, on the left side they are longitudinally positioned while on the right side they are positioned in a transverse direction with respect to the electrode surfaces of the anodes.

As the electrode surfaces of the anodes of the present invention are pressed against the diaphragms, said surfaces must be of the foraminous type, such as punched, or perforated or expanded metal sheets, to permit withdrawal of the chlorine bubbles towards the core of the brine contained inside the expandable anode. In the anodes commonly used in industrial plants, the said foraminous coarse sheets (E in FIGS. 2 and 3) have a thickness of 2–3 mm and the rhomboidal or square openings have diagonals 5–15 mm long.

Without limiting the present invention to a particular theory relating to the operation mechanisms, the low cell voltages obtained with the cell of the invention are deemed to be due to the minimum distance between anode and cathode, which is ensured by the effective pressure exerted against the diaphragm, which thereby maintains its original thickness and does not undergo any volume expansion due to hydratation of the fibers or to entrapping of gas bubbles. Conversely, the expandable anodes of the prior art, without the additional pressing means or springs of the present invention, remain spaced apart from the diaphragm, or in the case of occasional contact, they are just capable of exerting a slight pressure onto the diaphragm and therefore cannot avoid its expansion.

It is also probable that the high pressure exerted by the electrode surface of the anode compresses the diaphragm increasing the cohesion among the fibers forming the diaphragm and avoiding the removal by the chlorine gas bubbles. This hypothesis appears to be confirmed also by the increased stability according to the best preferred embodiment of the present invention wherein a thin foraminous sheet (M in FIGS. 2 and 3) is fixed onto the conventional coarse sheet constituting the anode commonly used in industrial plants. By fine foraminous sheet, it is intended a sheet having a thickness indicatively comprised between 0.5 and 1 mm and openings with average dimensions of 1–5 mm. This dual structure of the surfaces of the anodes of the present invention permits to obtain the necessary rigidity to transfer over the surface of the diaphragm the pressure exerted by said pressing means inside the anodes and to have a multiplicity of contact points which holds the fibers of the diaphragm in position far better than with the coarse screen only. The multiplicity of contact points permits also a further reduction of the cell voltage, as a consequence of a more homogeneous distribution of the current.

It has also been found that the cell voltage is unexpectedly low when the cell of the invention is equipped with hydrodynamic means (P in FIG. 4) as described in U.S. Pat. No. 5,066,378. This positive result is probably connected to the high circulation of brine which readily removes the chlorine bubbles at the anode-diaphragm interface. An intermediate result may be obtained without the aforesaid hydrodynamic means by resorting to downcomers positioned inside the anodes.

It is further surprising that, contrary to what is stated in the technical literature (Van der Stegen, Journal of Applied Electrochemistry, Vol. 19 (1980), pages 571–579), the present invention allows the cell voltage to be kept constant over time avoiding the increases ascribed to the formation of gas bubbles inside the diaphragm, while obtaining high current efficiencies even with the anodes in contact with the diaphragms. The positive results are most probably due to the particularly high tortuosity of the pores and to the lower average diameter of the pores caused by the strong compression exerted by the anodes onto the diaphragm fibers as a consequence of the strong pressure exerted by the pressing means of the present invention. It is further possible that an important contribution be due to the higher homogeneity in the distribution of pressure exerted by the anodes onto the diaphragms due to the plurality of points wherein the necessary pressure is applied onto the the anodes when more than one pressing means of the present invention is used for each anode.

It has been further surprisingly found that operating the cells assembled as above described, the negative effects of iron contained in the brine, that is the presence of hydrogen in chlorine, are substantially reduced. This may be also ascribed to the highly tortuous porosity of the diaphragms strongly compressed by the anodes. Due to this tortuosity, the growth of metal iron dendrites or magnetite results strongly hindered.

With the anodes strongly pressed against the diaphragms deposited onto the cathodes, extended defects in the diaphragm could lead to a contact between the anodes and the cathodes thus causing a short-circuit. To avoid said risk, the anodes may be provided with suitable spacers, as described in U.S. Pat. No. 3,674,676. Said spacers, however, hinder the reduction of the anode-cathode distance to zero and, therefore, constitute a serious obstacle to the minimization of the cell voltage. To avoid this problem, the invention foresees that the cathodes, made of a mesh of iron wire, are provided before deposition of the diaphragm, with a suitable thin plastic mesh applied onto the iron mesh or, in a simpler embodiment, by plastic wires interwoven in the iron mesh to form a protective layer. The diaphragm is then deposited according to conventional prior art procedures onto the cathodes thus prepared.

The pressing means of the invention (O, Q in FIG. 3) preferably have the form of a strip of corrosion resistant material, such as titanium, when a metallic material is used. The strip is longitudinally bent in order to ensure a certain elasticity to the edges of the strip itself. Due to its elasticity, the strip may be directly forced inside the anodes so that its edges press the electrode surfaces of the anode which are thus pressed against the diaphragm. The elasticity of the strip permits its positioning inside the anode without any pre-compression. The longitudinally bent strips of the above described type may have different cross-sections, for example in the form of C, V or omega.

The procedures for using the above described strips foresee that the anodes, in the contracted position as described in FIG. 2, are assembled between the cathodes of the cell, provided with the diaphragms, as in common industrial practice. The anodes are then expanded by removing the retainers (N in FIG. 2) which hold the electrode surfaces in the contracted position. Then, the pressing means of the invention (O, Q in FIG. 3) are inserted in said anodes. When the pressing means are made of strips having a V shaped cross-section, the following procedure may be used. The strips are inserted inside the expandable anodes thanks to the fact that the height of the ideal triangle formed by the two edges of the strip is kept lower than the distance between the larger surfaces after expansion. The strips are then rotated and forced against the electrode surfaces of the anodes, which thus result pressed against the diaphragms. The assembly formed by the electrode surfaces of the anodes and the strips maintain a certain elasticity due to the capability of each strip to increase or decrease the angle corresponding to the vertex of the V, depending on the degree of mechanical stress.

In the following examples, there are described several preferred embodiments of the invention. However, it should be understood that the invention is not intended to be limited to the specific embodiments. For example, it is evident to one skilled in the art that the present invention may be advantageously applied also to membrane cells of the so-called bag cell type which are obtained from existing diaphragm chlor-alkali cells using ion-exchange membranes in the form of a bag capable of enveloping the cathode.

EXAMPLE 1

Tests have been carried out in a chlor-alkali production line comprising diaphragm cells of the type MDC55, equipped with dimensionally stable anodes of the expandable type and conventional spacers to maintain the distance between the diaphragm and the electrode surface of the anode at about 3 mm. In this position, the anodes had a thickness of about 42 mm. The electrode surfaces were made of coarse expanded titanium mesh, having a thickness of 1.5 mm and with rhomboidal openings with diagonals of 6 and 12 mm respectively and coated by an electrocatalytic film comprising oxides of the platinum group metals. Such arrangement permits to obtain data typical of the prior art.

The operation conditions and results were the following:

| diaphragm in asbestos fibres with fluorinated polymeric binder MS2 type, 3 mm thickness (measured in a dry condition) | |
|---|---|
| current density | 2200 A/m2 |
| average cell voltage | 3.35 V |
| fresh brine | 315 g/l with a flow rate of about 1.6 m3/hour |
| outlet solution | |
| caustic | 125 g/l |
| sodium chloride | 190 g/l |
| average operating temperature | 95° C. |
| average oxygen content in chlorine | 3% |
| average hydrogen content in chlorine | less than 0.1% |
| average current efficiency | about 93% |

After 15 days of operation, one of the cells was shut down and opened. The spacers were removed to let the anodes expand completely. Two pressing means of the invention were inserted inside each anode and the electrode surfaces of the anodes were strongly pressed against the relevant diaphragms. The pressing means were titanium strips having the same length as that of the anodes, a thickness of 1 mm and a width of 70 mm, bent along the longitudinal axis in order to form a V with an angle of 90°. That is the cross section of the strips formed an ideal rectangular triangle having a base of 50 mm and a height relating to the base of 25 mm. The pressing means were inserted inside the anodes in order to have the base parallel to the electrode surfaces of the anodes and were then rotated by about 40 degrees, thus pressing the larger surfaces of the anodes against the diaphragms. The assembly anodes-pressing means retained a certain elasticity due to the elastic properties of the strips bent to form a V cross-section. The position of the pressing means (Q) inside the anodes was such as not to form with the internal surfaces of the extenders inside the anodes any downcomer for the degassed brine (without entrained chlorine gas bubbles). The cell thus modified was re-started up.

The same set up was adopted on two cells provided with new diaphragms which had not operated before. One of the two cells was filled with brine at ambient temperature to permit hydration of the diaphragm. The two cells, prepared as above mentioned, were installed in the production line. Once the operating parameters were stabilized, it was noted that the three cells equipped with the pressing means of the present invention were characterized by quite close voltage values, around about 3.25 Volts and therefore 0.1 Volts lower with respect to the average voltage value of all other cells set up according to the prior art teachings.

For comparison purposes, one cell of the production line having a voltage of 3.33 Volts was shut down and opened. The spacers were removed to let the anodes expand completely. The pressing means of the invention were not inserted in the cell. The cell was closed and started up. After stabilization of the operating parameters, the cell voltage was 3.35 Volts, that is quite close to the typical value of operation before shut down. For all of the four cells, no remarkable variation as regards to oxygen content in chlorine and current efficiency was detected with respect to the values typical of the operation before shut down and modifications.

EXAMPLE 2

One cell of the production line with an operation life of 20 days and a voltage of 3.35 Volts was shut down, the spacers were removed and the cell equipped with the pressing means of Example 1. The pressing means, unlike Example 1, were positioned inside each anode so as to form downcomers for the degassed brine with the internal surfaces of the extenders (O in FIG. 2) of the anodes. After start up of the cell and stabilization of the operation parameters, the cell voltage was 3.2 Volts with a gain of 0.14 Volts with respect to the cell voltage before shut down and about 0.04 Volts with respect to the cells according to the present invention described in Example 1. This positive result is a probable consequence of the better internal circulation of the cell, provided by the downcomers formed inside the anode.

EXAMPLE 3

Two cells equipped with new diaphragms and with anodes without spacers were provided with the pressing means inside the anodes as described in Example 1 and with hydrodynamic means (P in FIG. 4), one for each anode, of the type described in U.S. Pat. No. 5,066,378. In one of the two cells, each electrode surface of the anodes, made of the coarse titanium expanded sheet (E in FIGS. 2 and 3), with the same characteristics illustrated in Example 1, was further provided with an additional fine mesh (M in FIGS. 2 and 3) made of expanded titanium sheet, having a thickness of 0.5 mm and square openings with diagonals 4 mm long, coated with an electrocatalytic film comprising oxides of the platinum group metals. In both cells, the cathodes made of iron mesh, before deposition of the diaphragm, were coated with a polypropylene mesh made of a wire having a diameter of 1 mm, forming square openings with dimensions of 10×10 mm.

The two cells were inserted in the production line and after stabilization of the operation parameters, the cells voltages were 3.10 V and 3.15 V for the cell with and without the fine mesh onto the electrode surfaces of the anodes respectively. These improvements are probably due to the more efficient internal circulation favored by the hydrodynamic means and to the more homogeneous distribution of current typical of the multiplicity of contact points ensured by the fine expanded sheets.

A decrease of the oxygen content in chlorine to 1.5% and an increase of the current efficiency to about 96.5% were also detected. The operating parameters of the two cells were kept under control continuously. In a period of 180 days, a negligible increase of 0.05 V and an increase of 0.5% in the oxygen content in chlorine were detected. As regards to the content of hydrogen in chlorine, an increase up to 0.25% was detected in the cell without the fine mesh applied to the anodes after 97 days of operation. Said content remained then constant for the subsequent 83 days. The content of hydrogen in the chlorine of the second cell was instead unvaried throughout the operation. This different behavior of the two cells may be ascribed to the more efficient mechanical stabilization of the fibers ensured by the more homogeneous distribution of contact points with the diaphragm provided by the fine mesh.

EXAMPLE 4

A cell was equipped with new diaphragms as in Example 3, without spacers and provided with the fine mesh on the anode, hydrodynamic means and pressing means of the present invention positioned inside the anodes in order to form with the internal surfaces downcomers for the degassed brine. The cell showed the same behaviour as that of Example 3.

EXAMPLE 5

The cell of Example 3, characterized by the anodes provided with the fine mesh and the hydrodynamic means was fed, after 180 days of standard operation, with fresh brine added with 0.01 grams/liters of iron. For comparison purposes, the same addition was made to a reference cell in the production line which had been operating for 120 days. After 15 days of operation, the hydrogen in chlorine in both cells had raised to about 0.2%. However, while no further variation in the cell of the invention were detected, the content of hydrogen in the chlorine was continuously increasing in the reference cell, which was shut down when the hydrogen content reached 0.8%.

Various modifications of the cells and method of the invention may be made without departing from the spirit or scope thereof and it is to be understood that the invention is intended to be limited only as defined in the appended claims.

We claim:

1. A chlor-alkali diaphragm electrolysis cell comprising pairs of interleaved cathodes (C) and anodes (B), said cathodes having surfaces with openings and are provided with porous corrosion resistant diaphragms, said cell further comprising feed brine inlets and outlets (H, I, L) for the removal of produced chlorine, hydrogen and caustic, said anodes (B) are expanded by internal extenders (F) and have electrode surfaces with openings for releasing produced gaseous chlorine, characterized in that each of said expanded anodes (B) comprises in addition to the internal extenders a plurality of pressing means (O,Q) made of corrosion resistant material having elastic properties to maintain the electrode surfaces of the anodes to maintain constant and homogeneously distributed pressure of the anodes' surfaces against the diaphragm and said pressing means are longitudinally positioned inside the anodes.

2. The cell of claim 1 wherein said pressing means (O, Q) are strips bent longitudinally.

3. The cell of claim 2 wherein said strips (O, Q) have a C-, V- or omega-shaped cross-section.

4. The cell of claim 3 wherein said strips having a V-shaped cross section have the form of an ideal triangle whose base, defined by edges of said strips, is higher than its height and said height is smaller than the width of said anodes (B).

5. The cell of claim 1 wherein in that said electrode surfaces of the expanded anodes are made of a coarse expanded metal sheet (E) having rhomboidal or square openings with diagonals comprised between 5 and 20 mm, and a thickness comprised between 1 and 3 mm.

6. The cell of claim 1 wherein said pressing means (O) are in contact with said extenders (F) to form downcomers to convey downcoming flow of the degassed brine.

7. The cell of claim 1 wherein at least part of said anodes (B) are provided with hydrodynamic means (P) to increase internal circulation of brine.

8. The cell of claim 1 wherein said cathodes (C) are provided with fine meshes or wires made of electrically insulating material positioned between the cathodes and said diaphragm or membrane.

9. The cell of claim 8 wherein said wires are interwoven on the surface of said cathodes.

10. The cell of claim 1 wherein said electrode surfaces of the expanded anodes (B) are further provided with a fine mesh or sheet with openings (M), said fine sheet or mesh having a thickness comprised between 0.2 and 1 mm and openings with dimensions comprised between 1 and 5 mm.

11. The cell of claim 10 wherein the fine mesh or sheet (M) is an expanded metal sheet.

* * * * *